United States Patent [19]

Hollis

[11] 4,228,728

[45] Oct. 21, 1980

[54] METHOD AND APPARATUS FOR REMOVING GUSSETS FROM FLAT TUBES

[75] Inventor: Alberta M. Hollis, Camden, Ark.

[73] Assignee: International Paper Company, New York, N.Y.

[21] Appl. No.: 18,722

[22] Filed: Mar. 8, 1979

[51] Int. Cl.[3] ..... B31B 1/26

[52] U.S. Cl. ..... 93/84 TW; 93/28; 93/32; 93/84 FF

[58] Field of Search ..... 93/28, 84 FF, 84 R, 93/35 R, 84 TW, 14–17, 21–25, 29, 30, 32; 270/69, 61 R

[56] References Cited

U.S. PATENT DOCUMENTS

| | | | |
|---|---|---|---|
| 795,046 | 7/1905 | Lorenz | 93/32 |
| 832,850 | 10/1906 | Dulin et al. | 93/28 |
| 1,165,765 | 12/1915 | Duvall | 93/28 |
| 2,159,853 | 5/1939 | Johnson | 93/28 |
| 2,888,859 | 6/1959 | Dambacher | 93/28 |
| 3,059,550 | 10/1962 | Wellman | 93/29 |
| 3,361,041 | 1/1968 | Grob | 93/8 R |
| 3,547,010 | 12/1970 | Gennerick et al. | 93/28 X |
| 3,870,292 | 3/1975 | Bradley | 270/69 X |
| 3,897,530 | 7/1975 | Leathers | 93/84 FF X |
| 3,913,463 | 10/1975 | Hollis | 93/28 |

*Primary Examiner*—James F. Coan

*Attorney, Agent, or Firm*—Luedeka & Fitch

[57] ABSTRACT

A method and apparatus for removing longitudinal gussets from a flat tube of flexible material, such as paper, including a conveyor for conveying the flat tube along a guide path to a gusset removal station having means operative to separate opposite side panels of the flat tube at their leading edges while simultaneously effecting a drag on one of the side panels as one of the forward leading edges enters the nip of feed rolls so that the gussets are removed and lie substantially coplanar with the opposite side panels of the tube to enable subsequent forming of cuffs at one end of the tube preparatory to replacing the gussets and closing the opposite end of the tube.

29 Claims, 12 Drawing Figures

METHOD AND APPARATUS FOR REMOVING GUSSETS FROM FLAT TUBES

The present invention relates generally to the manufacture of tubular bags of the type having longitudinal gussets formed along opposite sides thereof, and more particularly to a novel method and apparatus for removing the longitudinal gussets from a substantially flat tube of flexible material so as to prepare the tube for forming a circumferential cuff at one end of the tube.

In the manufacture of certain types of bags made of flexible material, such as paper, and more particularly to bags having closed bottoms and longitudinal gussets formed along opposite sides which facilitate folding of the bag into a flat tube for storage and shipping, it is sometimes necessary in using the bag to cuff the end of the bag opposite its closed end. For example, household compactors which require the insertion of a collector bag into a generally rectangular drawer or pressure cavity have, in the past, required that the compactor bag be cuffed by the user before installing it into the compactor receiving cavity.

To facilitate cuffing of the open end of the bag, longitudinal slits may be formed along diametrically opposite side edges of the bag, generally along diametrically opposite fold lines defined between the gusset panels and corresponding side panels of the bag. By providing such longitudinal slits adjacent the open end of the bag, a circumferential cuff may be readily formed by the user while the bag is in a flat tubular condition with the gussets removed from their internally folded positions between the side panels of the flat tube. More recent customer specifications for certain types of bags, and particularly bags for use in household compactors, require that the bags be pre-cuffed so that the customer does not have to form a cuff on the bag preparatory to using it.

One of the primary objects of the present invention is to provide a novel method and apparatus for removing longitudinal gussets from a substantially flat tube of flexible material.

A more particular object of the present invention is to provide a method and apparatus for removing longitudinal gussets from the opposite edges of a flat tube of flexible material by passing the flat tube through a gusset removing station having first means operative to separate the leading edges of the tube, and second means operative to apply a drag against one of the side panels of the flat tube as a leading edge of the opposite side panel is received between and advanced by feed rolls so as to remove the internally folded gussets from between the opposite side panels of the flat tube to enable cuffing of one end of the tube prior to forming a sealed and closed bottom on the tube.

Another object of the present invention is to provide a method and apparatus for removing longitudinal gussets from a substantially flat tube of flexible material wherein each of the gussets includes a pair of gusset panels connected to each other along longitudinal fold lines and connected to respected ones of the side panels of the tube through fold lines such that the gusset panels may be folded interiorly of the side panels with the tube in a substantially flat condition, and wherein the gusset removing station includes air flow diffuser means cooperative with lifter cam means to separate the leading edges of the side panels from each other, and air flow drag means positioned upstream of the diffuser means and adapted to apply a dray to one of the side panels of the tube so that as the tube progresses through the tube removing station, the gusset panels are removed to lie substantially coplanar with the respective side panels of the tube.

A feature of the gusset removing station in accordance with the invention lies in the provision of a unique air flow diffusing device having an annular air diffusing orifice intersecting a contact surface engaged by a side panel of the flat tube as it progresses through the gusset removing station so that air discharged from the orifice maintains the adjacent side panel in sliding relation against the contact surface while enabling the opposite side panel to drop away and separate the leading edges of the side panels.

Still another feature of the present invention lies in the provision of novel air flow drag means cooperative with the flat tube as it passes through the gusset removing station to apply a drag to the side panel opposite the side panel in sliding relation with the air diffusing device so that the side panels undergo relative movement in generally parallel planes and effect removal of the longitudinal gusset panels from between the side panels of the tube.

Still another feature of the gusset removing station in accordance with the present invention lies in its ability to remove the gussets from between the opposite side panels of a substantially flat tube so as to effect predetermined orientation of longitudinal splits formed in diagonally opposite leading and trailing edges of the tube when the gussets are removed.

Further objects and advantages of the present invention, together with the organization and manner of operation thereof, will become apparent from the following detailed description of the invention when taken in conjunction with the accompanying drawings wherein like reference numerals designate like elements throughout the several views, and wherein.

Figure 1:
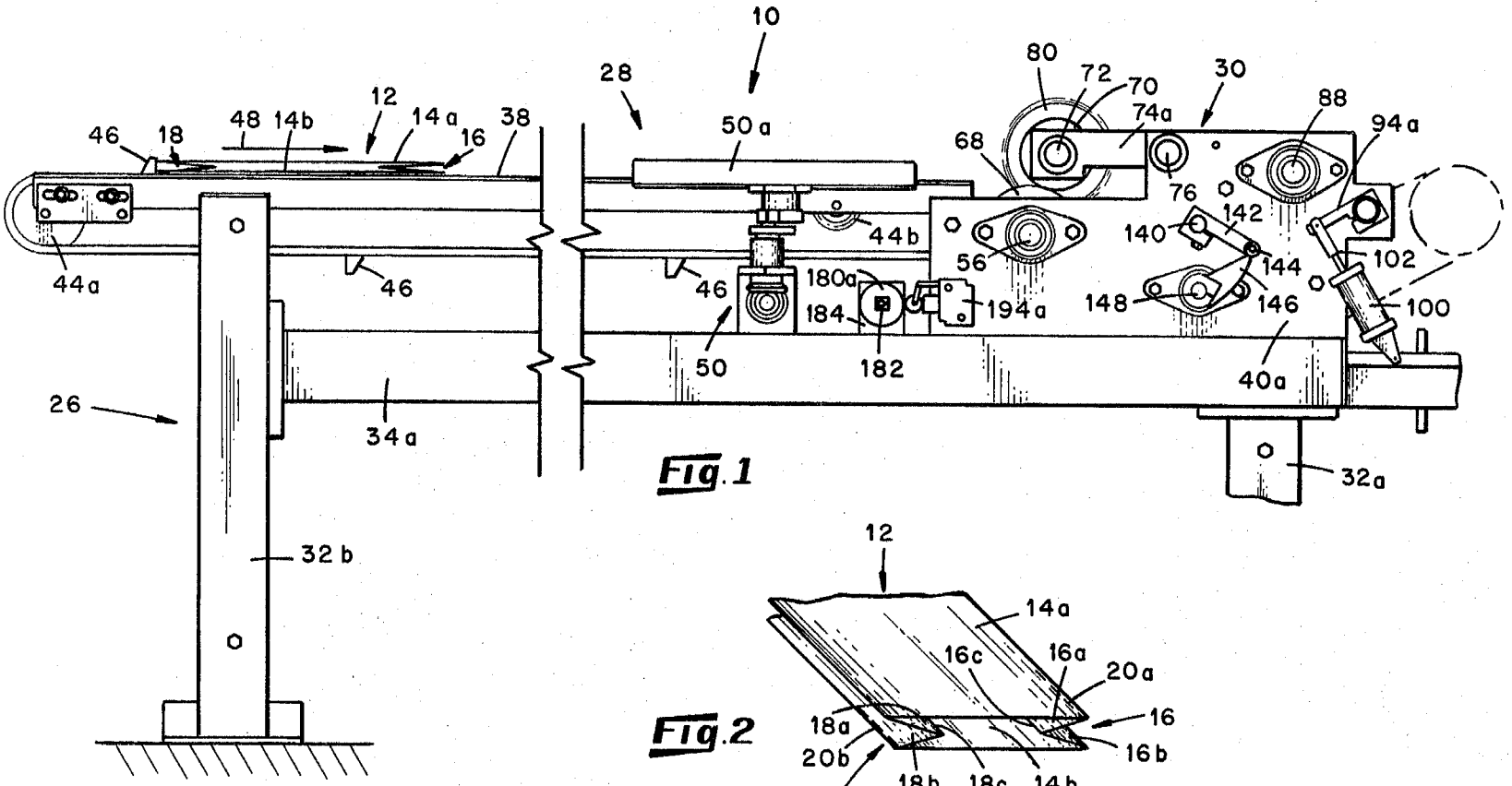
FIG. 1 is a fragmentary side elevational view of apparatus for removing gussets from a substantially flat tube of flexible material in accordance with the present invention.

Referring now to the drawings, and in particular to FIGS. 1-4, apparatus in accordance with the present invention for removing longitudinal gussets from a substantially flat tube of flexible material while conveying or moving the tube along a guide path in a direction transverse to the longitudinal axis of the tube is indicated generally at 10. The apparatus 10, which may alternatively be termed a system for removing gussets from a substantially flat tube of flexible material, finds particular application in removing longitudinal gussets from a substantially flat tube of paper material, such as indicated generally at 12, preparatory to forming a circumferential cuff at one end of the tube and thereafter reinserting the gussets and folding and sealing the opposite end of the tube so as to form a pre-cuffed bag.

Figure 2:
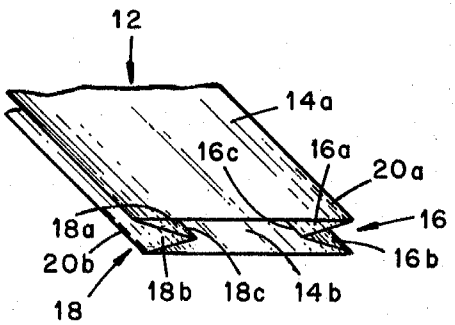
FIG. 2 is a fragmentary perspective view illustrating a flat tube having a longitudinal gussets folded inwardly preparatory to removing the gussets in accordance with the apparatus of FIG. 1.

A substantially flat tube 12 of the type having longitudinal gussets is illustrated in the fragmentary perspective view of FIG. 2. The tube 12 has opposite substantially planar side panels 14*a* and 14*b* interconnected by longitudinal gussets indicated generally at 16 and 18. Each of the gussets includes a pair of gusset panels 16*a*, 16*b* and 18*a*, 18*b*, respectively, each pair of gusset panels being interconnected to each other along longitudinal fold lines 16*c* and 18*c*, respectively, and being connected to the respective side panels 14*a*, *b* through fold lines such that the gusset panels may be folded interiorly of the side panels to lie in juxtaposed relation therebetween, as is known. For purposes of illustration, the tube 12 is shown in FIG. 2 with its side panels 14*a*, *b* slightly separated.

In making paper bags, it is conventional to employ sheet material which is folded to form the longitudinal gussets 16 and 18 after which the tube is completed by seaming and is cut to desired lengths at a high rate of speed. Each of the tubes thus formed has a closed bottom formed thereon in a subsequent operation. For certain applications, such as bags used in waste compactors and the like which must be cuffed at the top, two longitudinal slits are formed in the tube 12, such as indicated by dash lines 20*a* and 20*b* in FIG. 2, which intersect the end of the tube which will subsequently be folded to form a circumferential cuff thereon. To form the cuff, the gussets must be pulled out of the tube to form substantially planar front and rear surfaces, alternatively termed top and bottom surfaces, which facilitate cuffing. As will be described in greater detail, the apparatus or system 10 is adapted to remove the gussets 16 and 18 from the tube 12, i.e. from positions folded interiorly between the side panels 14*a* and 14*b*, to enable cuffing, and more particularly, the apparatus is adapted to remove the gussets so that the slits 20*a* and 20*b* formed in diametrically opposite fold edges of the folded tube are disposed at the leading and trailing edges of the resulting flat tube.

For effecting movement of substantially flat tubes of flexible material through a predetermined guide path during which the longitudinal gussets are removed, the apparatus 10 includes frame means 26 which supports conveyor means 28 adapted to sequentially guide substantially flat tubes 12 to a gusset removing station 30 also supported by the frame means 26 in longitudinal alignment with the conveyor means 28. The frame means 26 includes upstanding frame members 32*a* and 32*b* which support horizontal laterally spaced frame channels 34*a*, *b* so as to form a substantially rectangular framework.

A plurality of horizontal support or guide rails 38 are supported in parallel spaced relation longitudinally of the frame means 26 by a pair of transverse support rods 39*a* and 39*b* secured, respectively, to and between the upper ends of the frame members 32 and a pair of upstanding support plates 40*a* and 40*b*. The guide rails 38 are supported in coplanar relation and cooperate to support and define a guide path along which flat tubes 12 may be sequentially advanced toward the gusset removing station 30. Preferably, the innermost support and guide rail, indicated at 38*a* has an upstanding flange 38*b* on its innermost edge against which the adjacent ends of the folded tubes may be positioned during movement along the conveyor.

To effect movement of the flat tubes along the guide rails 38, a pair of endless chains or belts 42*a* and 42*b* are reeved over suitable aligned pairs of sprockets or pulleys 44*a* and 44*b* so as to establish horizontal reaches or runs substantially coplanar with the guide rails 38. As used herein, components termed chains and sprockets may generally be interchanged with belts and pulleys as desired. The conveyor chains 42*a*, *b* have lugs 46 mounted thereon in spaced relation for engaging the trailing edge of a flat tube 12 and advancing the tube along the conveyor in a direction transverse to the longitudinal axis of the tube. Preferably a vibrating type spanker 50 of conventional design is mounted on the horizontal frame channel 34*a* and has a longitudinally extending spanker bar 50*a* adapted to engage and spank the ends of the flat tubes as they pass the spanker means so as to urge the tubes against the flange 38*b* and thus establish consistent positioning of the flat tubes as they exit the conveyor means 28 into the gusset removing station 30.

To effect synchronous movement of the conveyor chains 42*a*, *b* the conveyor chains are reeved about drive sprockets 54*a* and 54*b*, respectively, fixed on a transverse drive shaft 56 rotatably supported by and between the upstanding support plates 40*a*, *b*. A drive sprocket 58 is fixed on an outer end of the drive shaft 56 outwardly from the support plate 40*b* and has operative cooperation with a drive chain 60 which is driven through a drive gear 62 driven by a suitable motor drive (not shown) so as to effect constant speed movement of the drive chain 60 which, as will be described more fully hereinbelow, is operative to drive various components of the gusset removing station 30 in synchronized relation, in addition to providing the motive drive for the conveyor chains 42*a*, *b*.

As a flat tube 12 is advanced by the conveyor means 28 to the gusset removing station 30, the leading edges of the flat tube are received by first feed roll means in the form of sets of feed or nip rolls 68 and 70 which serve to initiate advance of the flat tube through the gusset removing station 30. In the illustrated embodiment, three feed or nip rolls 68 are fixed on the transverse drive shaft 56 in axial spaced relation therealong and have diameters such that a flat tube coming off the discharge end of the conveyor chains 42*a* is substantially tangent to the feed rolls 68. A corresponding number of nip rolls 70 are fixed in axially spaced relation on a transverse shaft 72 journaled on and between a pair of support arms 74*a*, *b* which are fixed on a transverse pivot shaft 76 journaled to and between the upstanding support plates 40*a*, *b*. To effect synchronized driving rotation of the feed rolls 68 and 70, the support shaft 72 is interconnected to the transverse drive shaft 56 through a suitable gear arrangement including spur gears 78 and 80 mounted, respectively, on the shafts 56 and 72 so as to provide equal surface speeds at the nip between the rolls 70 and 68. The feed rolls 70 are capable of movement away from the associated feed rolls 68 to accommodate the thickness of a flattened tube 12 therebetween while the spur gears 78 and 80 maintain driving interconnection between the feed rolls.

The gusset removing station 30 includes second feed roll means in the form of a plurality of identical feed rolls 86 and a corresponding number of pinch rolls 88 each of which is cooperable with one of the feed rolls 86. The feed rolls 86 are mounted in axially spaced relation on a transverse support shaft 90 journaled to and between the support plates 40*a, b* and having an end extending outwardly of the support plate 40*b* upon which a sprocket 92 is mounted for driving connection to the chain 60. The pinch rolls 88, which may also be termed feed or pressure rolls, are each rotatably carried by a support arm 94 mounted on a transverse shaft 96 which is journaled to and between the support plates 40*a, b* and has an end extending outwardly of the support plate 40*a* on which an actuating arm 94*a* is mounted. A fluid pressure operated actuating cylinder 100, which preferably comprises a single acting pneumatic actuating cylinder, is mounted on the frame means 26 and has its piston rod 102 pivotally connected to the actuating arm 94*a* to enable movement of the pinch rolls 88 relative to the corresponding feed rolls 86, as will be described in greater detail hereinbelow.

The feed rolls 86 and associated pinch rolls 88 are positioned downstream from the feed rolls 68 and 70 so as to receive a flat tube 12 as it passes through the gusset removing station. The feed rolls 86, 88 are spaced from the feed rolls 68, 70 a distance slightly less than the lateral width of a flat tube so that the upstream feed rolls 68, 70 feed the upper leading edge of the tube into the nip between the downstream feed rolls 86, 88 after separating the leading edges in a manner to be described.

As aforementioned, and in accordance with an important feature of the present invention, the gusset removing station 30 includes means for removing the gussets 16 and 18 from their inwardly folded positions between the side panels 14*a, b* of a flat tube 12 as the tube is moved through the gusset removal station. To effect such gusset removal, the gusset removal station 30 includes edge separating means 108 positioned in the path of movement of a tube through the gusset removing station and operative to separate the two leading edges of the tube defined by the fold lines interconnecting the gusset panels 16*a, b* to the respective side panels 14*a*, and 14*b*. The means for removing the gussets from a flat tube also includes tube holder or drag means 110 positioned in the path of movement of a flat tube through the gusset removing station and operative to selectively apply a drag to the downwardly facing side panel 14*b* of the flat tube as it traverses the gusset removal station. Applying a drag to the bottom side panel 14*b* of a forwardly moving flat tube 12 substantially simultaneously with separating the forward leading edges thereof enables the upper leading edge to enter the nip between the feed roll 86 and pinch roll 88 and cause continued forward advance of the upper side panel 14*a* relative to the lower side panel 14*b* during which the forward gusset panel 16*b* and rear gusset panel 18*a* are withdrawn from their inwardly folded positions so as to lie substantially coplanar with the lower and upper side panels 14*b* and 14*a*, respectively, of the flat tube.

Figure 3:
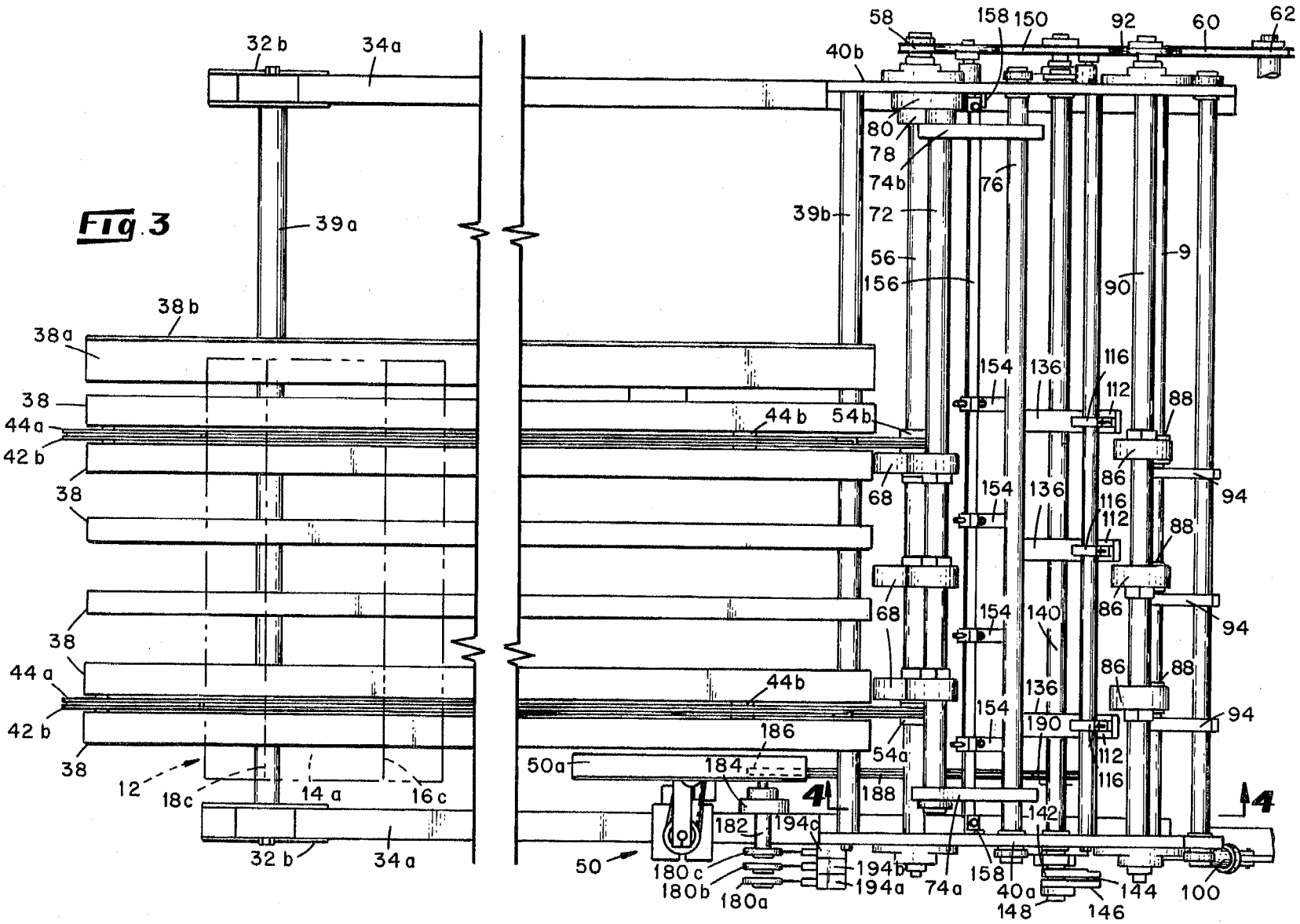
FIG. 3 is a fragmentary plan view of the apparatus of FIG. 1.
Figure 4:
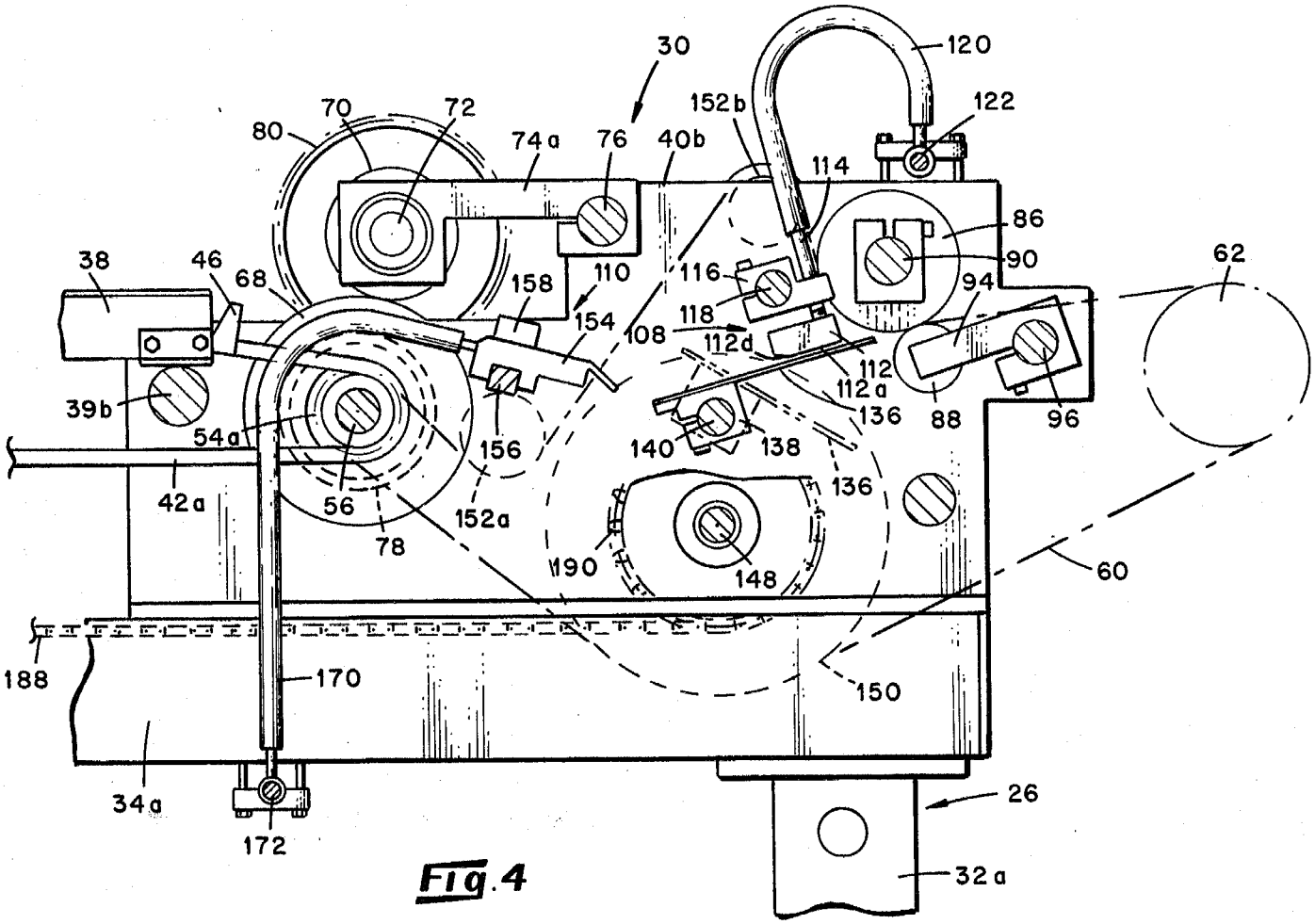
FIG. 4 is a fragmentary longitudinal sectional view through the gusset removing station of the apparatus of FIG. 3, taken substantially along line 4—4 of FIG. 3, looking in the direction of the arrows.
Figure 5:
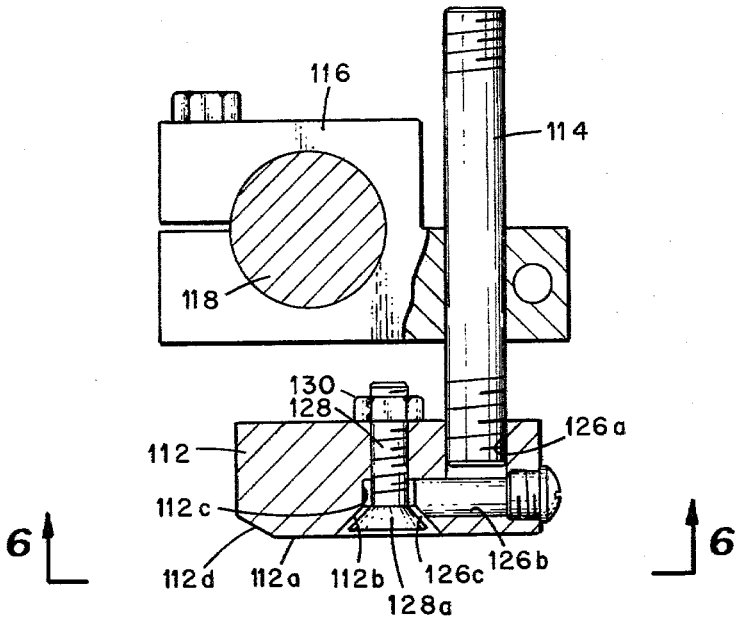
FIG. 5 is a fragmentary sectional view of a flow diffusing device employed in the gusset removing station illustrated in FIG. 4.
Figure 6:
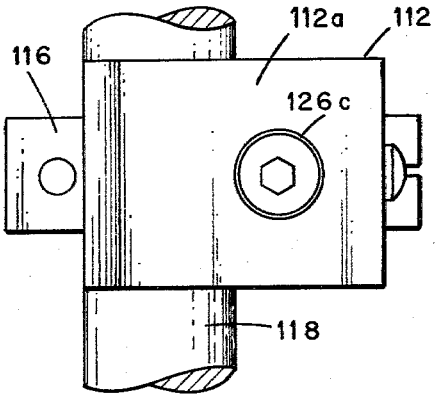
FIG. 6 is a fragmentary bottom view of the air flow diffusing device of FIG. 5, taken substantially along line 6—6 of FIG. 5, looking in the direction of the arrows.

With particular reference to FIGS. 4–6, taken in conjunction with FIGS. 1 and 3, the edge separating means 108 includes air flow diffuser means in the form of a plurality of diffuser blocks or housings 112 each of which is mounted on the lower end of a rigid air flow tube 114 supported by a support bracket 116 mounted on a transverse shaft 118 so as to be adjustable thereon. In the illustrated embodiment, three diffuser blocks and their associated mounting brackets 116 are mounted in spaced relation along the support shaft 118, as best seen in FIG. 3. The diffuser blocks are mounted so that lower planar contact surfaces 112*a* thereon angularly inclined upwardly from horizontal in the downstream direction of movement of a flat tube through the gusset removing station. Each air flow tube 114 is connected through a flexible air flow tube 120 to a transverse air manifold 122 mounted on one or both of the support plates 40*a, b* and connected to a suitable source of air flow (not shown).

Each diffuser block 112 has an internal flow passage 126*a* (FIG. 5) which is internally threaded to facilitate mounting of the diffuser block on the lower threaded end of its associated flow tube 114. The passage 126*a* intersects a transverse flow passage 126*b* which in turn intersects an annular outwardly diverging air diffuser orifice 126*c* which intersects the lower planar surface 112*a* of the diffuser block. In the illustrated embodiment, the diverging flow orifice 126*c* is formed between a frustoconical countersink surface 112*b* in the diffuser block and an outer frustoconical surface 128*a* on the head of a flathead screw 128. The screw 128 has threaded connection with the diffuser block and has a lock nut 130 threaded on its outer end to secure the screw in fixed relation to the diffuser block, preferably with the exposed planar surface of the head 128*a* lying in a plane spaced slightly inwardly from the surface 112*a*. An annular mixing passage or chamber 112*c* is preferably formed about the shank of screw 128 and intersects orifice 126*c* to enable more even flow of air through the diverging flow orifice 126*c* from passage 126*b*. In this manner, air passing through the flow tubes 120 and 114 from the manifold 122 is discharged through the discharge orifices 126*c* in the diffuser blocks 112 in an outwardly diffusing annular air stream. The diffuser blocks 112 preferably are chamfered at 112*d*.

The edge separating means 108 also includes lifter cam means in the form of a plurality of planar cam plates 136 (FIGS. 2 and 4) corresponding in number to the diffuser blocks 112 and each being mounted through a bracket 138 on a transverse support shaft 140 so that each cam plate underlies a corresponding diffuser block. The support shaft 140 extends outwardly from the mounting plate 40*a* and has an actuating arm 142 fixed thereon which rotatably carries a cam follower roller 144. The cam follower roller 144 maintains rolling contact with a cam 146 secured on the end of a cross shaft 148 journaled to and between the support plates 40*a, b*. The end of the cross shaft 148 opposite the end upon which the cam 146 is mounted extends outwardly of the support plate 40*b* and has a sprocket 150 fixed thereon for cooperation with the chain 60 so as to rotate in timed synchronous relation with movement of the conveyor chains 42*a, b* and rotation of the feed rolls 68, 70 and 86, 88 of the gusset removing station 30. Idler sprockets 152*a* and 152*b* are suitably mounted outwardly of support plate 40*b* for cooperation with chain 60 to establish a desired path of movement for the chain.

The cam 146 is configured so that for each revolution of the cross shaft 148, the cam plates 136 will move between downwardly inclined positions spaced some distance from the associated diffuser blocks 112, as indicated in phantom in FIG. 4, and positions wherein the cam plates are in relatively closely spaced relation to the contact surfaces 112*a* on the diffuser blocks, as shown in solid lines in FIG. 4. In this manner, the cam plates 136 may selectively urge the upper side panel 14*a* of a flat tube 12 passing between the cam plates and diffuser blocks against the contact surfaces 112*a* on the diffuser blocks.

Figure 7:
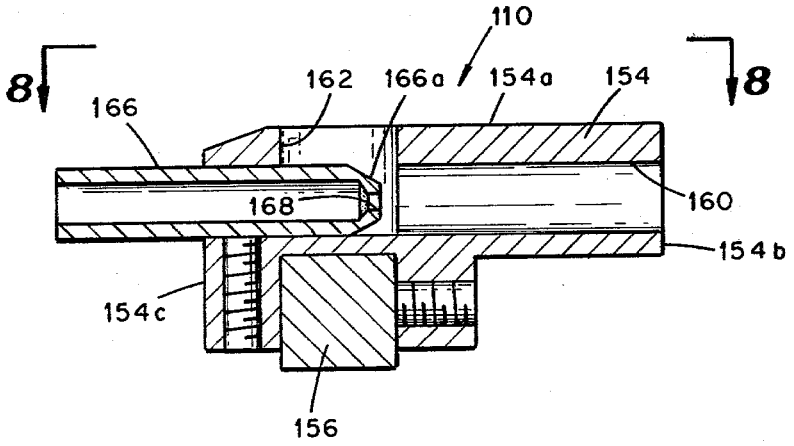
FIG. 7 is a longitudinal sectional view of an air flow drag device employed in the gusset removing station of FIG. 4.
Figure 8:
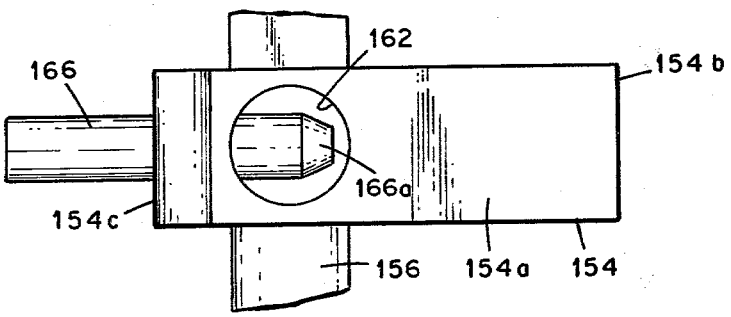
FIG. 8 is a plan view taken substantially along the line 8—8 of FIG. 7, looking in the direction of the arrows.
Figures 9, 10A, 10B, 10C:
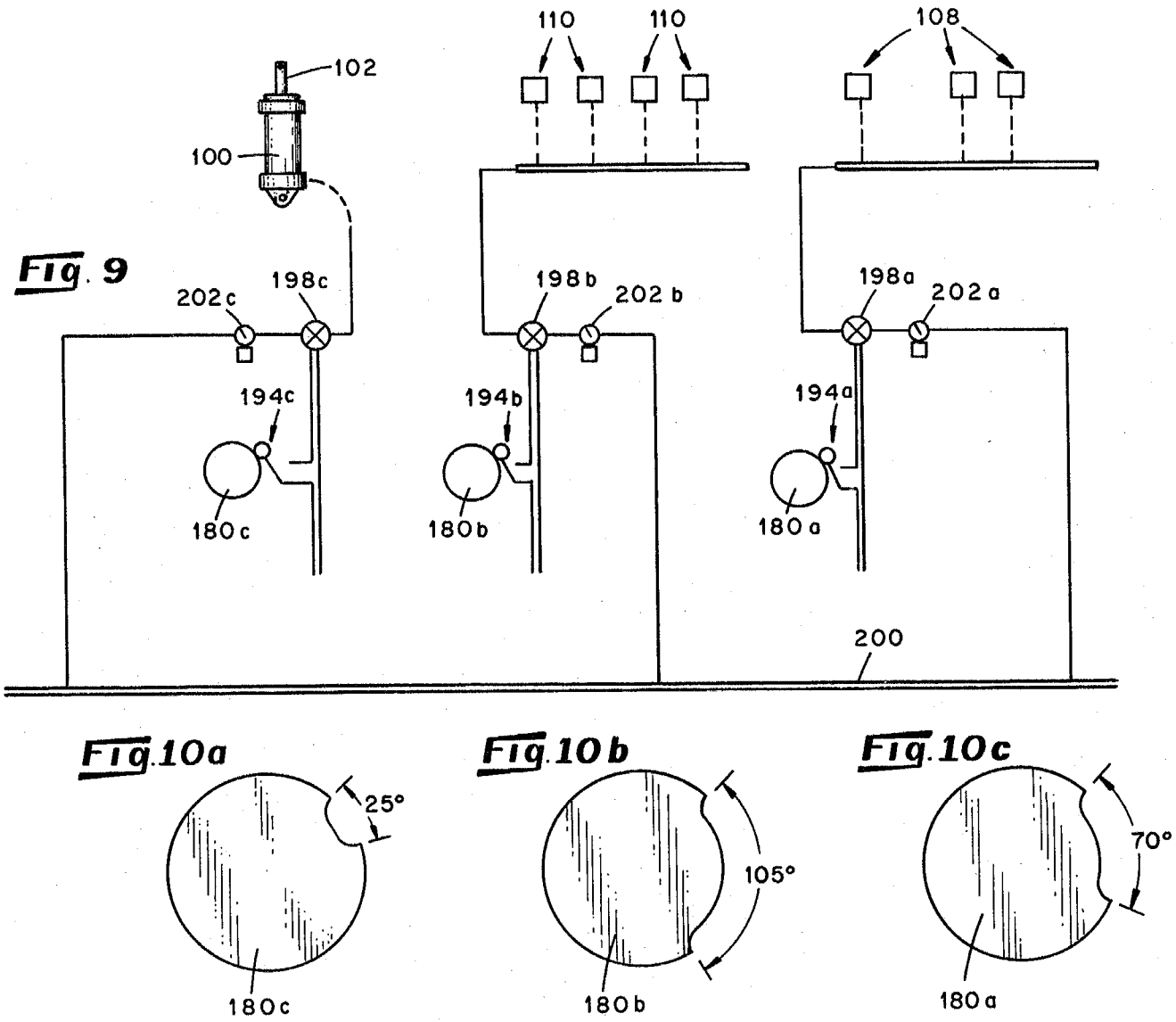
FIG. 9 is a schematic control circuit diagram for the gusset remsving station of FIG. 4.
FIGS. 10*a–c* are detail views of the control cams illustrated schematically in FIG. 8.

As aforementioned, the tube holder or drag means 110 is adapted to selectively apply a drag to the lower surface 14*b* of a flat tube 12 as it traverses the gusset removing station. Referring to FIGS. 7 and 8 taken with FIGS. 3 and 4, the tube holder or drag means 110 in the illustrated embodiment includes four air flow brake housings 154 mounted in spaced relation along the length of a transverse support bar 156 fixed to and between the support plates 40*a, b* by brackets, one of which is indicated at 158. The air flow brake housings 154 have coplanar upper surfaces 154*a* which receive and support a flat tube 12 passing downstream from the feed rolls 68 and 70 so as to guide the leading edges of the flat tube onto the upper surfaces of the cam plates 136. The upper surfaces 154*a* of the brake housings 154 are inclined angularly downwardly from horizontal and have their upstream ends disposed slightly lower than the nip between the feed rolls 68 and 70 so that the leading edges of a flat tube drop onto the housings 154 after exiting from the feed rolls 68, 70, followed by sliding engagement of the lower surface 14*b* of the flat tube on the surfaces 154*a*.

Each brake housing 154 has a cylindrical air flow passage 160 extending longitudinally therethrough so as to intersect forward and rearward edge surfaces 154*b* and 154*c*, respectively, on the housing 154. A cylindrical air flow passage 162 of greater diameter than passage 160 is formed transversely in each brake housing 154 so as to intersect the associated outer surfaces 154*a* and internal air flow passage 160. A tubular nozzle 166 is mounted within the upstream end of the flow passage 160 and has a restricted flow orifice 168 in a discharge end 166*a* thereof so that gas, such as air, passing through the nozzle 166 creates a venturi effect through the flow orifice 168 to establish a reduced pressure on the discharge end of the flow orifice and thereby effect air inflow through the orifice 162 to and outwardly of the orifice 160. Each nozzle 166 is connected through a flexible flow conduit 170 to a transverse air manifold 172 mounted on the frame means 26 and connected to an air flow supply in a similar manner to the aforedescribed air manifold 122. Preferably, an air flow diverting shield 174 is mounted on each of the brake housings 154 to divert the air discharging from the flow passages 160 downwardly away from the flat tubes 12 passing over the brake housings.

In operation, a flat tube 12 is placed upon the conveyor means 28, either manually or by a supply conveyor (not shown), so that the tube rests on the guide rails 38 with its longitudinal axis transverse to the direction of movement of the conveyor chains 42*a, b*. The trailing edges of the flat tube are engaged by a pair of lugs 36 on the conveyor chains 42*a, b* which move the tube along the conveyor and cause its leading edges to be received between the feed rolls 68 and 70 which effect continued movement of the tube from the conveyor means into the gusset removing station 30.

As the flat tube advances through the feed rolls 68 and 70, its leading edges drop by gravity onto the upper surfaces 154*a* of the air brake housings 154 and progress forwardly such that the leading edges engage the upper surfaces of the cam plates 136 which are disposed in their downwardly inclined positions spaced from the diffuser blocks 112, as shown in phantom in FIG. 4. As the feed rolls 68 and 70 continue to feed the flat tube through the gusset removal station 30, the rotating cam 146 operates the actuating arm 142 to move the cam plates 136 from their lowered positions toward their upper positions closely spaced from the diffuser block surfaces 112*a*. Such movement of the cam plates 136 is timed so that as the forwardly progressing flat tube underlies the diffuser blocks 112, the tube is raised to engage the side panel 14*a* against the diffuser block surfaces 112*a*. The supply of air to the diffuser blocks 112 is such that air is discharged through the diffuser orifices 126*c* as the upper side panel 16*a* of the flat tube engages the contact surfaces 112*a*. The air discharged from diffuser orifices 126*c* creates a pressure differential on the adjacent side panel of the tube so as to retain the side panel against the contact surface, while simultaneously creating a fluid film between the contact surfaces and the tube side panel to enable continued movement of the side panel relative to the diffuser blocks.

The air supply to the nozzles 166 in the air brake housings 154 is such that air is discharged through the nozzles 166 as the leading portions of the tube side panels are raised by cams 136 to effect contact of the upper side panel 14*a* against the diffuser blocks 112. Discharge of air through nozzles 166 creates a pressure differential between the air passages 162 and the discharge passage 160 adjacent the discharge orifices 168 so that a suction drag is established at the inlets of passages 162 which acts on the lower side panel 14*b* of the flat tube engaging the upper surfaces 154*a* on the brake housings.

The operating relationships of the edge separating means 108, tube holder or drag means 110 and movement of the pinch rolls 88 may be understood by reference to FIGS. 9 and 10*a–c*, taken in conjunction with FIGS. 1, 3 and 4. Actuation of the air cylinder 100 to effect movement of the pinch rolls 88, and control of the air supply to the manifolds 122 and 172 is effected by timing cams 180*a, b*, and *c* which are fixed coaxially on a common support shaft 182 journaled in a support bracket 184 mounted in upstanding relation on the horizontal frame channel 34*a*. The support shaft 182 has a timing sprocket or pulley 186 (FIG. 3) fixed on its inner end which is connected through a chain or belt 188 to a timing sprocket or pulley 190 mounted on the cross shaft 148 so as to be rotatable therewith.

Each control cam 180*a, b* and *c* has a suitable normally open control switch 194*a, b* and *c*, respectively, operatively associated therewith so that the control switches are selectively closed during each revolution of the corresponding control cams 180*a–c*. The control switches 194*a–c*, which may comprise microswitches of conventional design, are mounted on the upstanding support plate 40*a* adjacent their respective control cams 180*a–c*. As illustrated schematically in FIG. 9, the control cam 180*a* is operatively associated with its control switch 194*a* so as to close switch 194*a* during a portion of each revolution of cam 180*a* to energize and open a normally closed solenoid control valve 198*a* which enables air flow from a main supply line 200 to the air manifold 122 and thus effects discharge of air through the orifices 126c in the diffuser blocks 112. Preferably a pressure regulator valve 202a of known design having a built-in pressure gauge is provided in the flow line between the air manifold 122 and the supply line 200. In the illustrated embodiment, the control cam 180a is adapted to maintain the switch 194a closed and thus effect discharge of air through the diffuser block orifices 126c during 290° of each revolution of the cam 180a.

In a similar manner, the control cam 180b is operative to close its associated control switch 194b so as to energize and open a normally closed solenoid valve 198b to interconnect the air manifold 172 to the air supply line 200 and thus effect discharge of air through the nozzles 166 in the drag means 110 and effect inflow of air through the air flow passages 162. A pressure regulator and associated pressure gauge 202b of conventional design is also provided in the flow line between the air manifold 172 and supply line 200. In the illustrated embodiment, the control cam 180b maintains its associated control switch 194b in a closed condition for approximately 255° of each revolution thereof.

The control cam 180c is operative to selectively close its associated control switch 194c to energize and open a normally closed solenoid control valve 198c so as to introduce air pressure from the supply line 200 into the fluid actuating cylinder 100 and move the pinch rolls 88 against their associated feed rolls 86. A pressure regulator and gauge 202c is preferably provided in the flow line between the cylinder 100 and air supply line 200. In the illustrated embodiment, the control cam 180c is operative to maintain the pinch rolls 88 against the associated feed rolls 86 for approximately 335° of each revolution of cam 180c.

As aforementioned, rotation of the control cams 180a–c is synchronized with movement of the conveyor chains 42a, b and also with movement of the cam 146 through the timing chain 188. The various operating relationships are established so that as a flat tube 12 moves through the feed rolls 68 and 70 upon leaving the conveyor means 28, the leading edges of the flat tube move over the upwardly facing surfaces 154a of the brake housings 154 and engage the upper surfaces of the cam plates 136 which are then caused by cam 146 to lift the tube and engage the side panel 14a against the diffuser block surfaces 112a. Simultaneously with movement of the advancing flat tube against the diffuser block surfaces 112a, air is discharged from the diverging orifices 126c in a manner to maintain or hold the upper panel 14a of the flat tube against the surfaces 112a while allowing the upper panel to readily slide across the surfaces 112a on a film of air. It will be appreciated that in this manner the upper side panel of the tube does not actually engage the contact surfaces of the diffuser blocks 112, but is slightly spaced therefrom by a thin film of air.

As the leading edges of the moving flat tube reach approximately the downstream edges of the diffuser blocks 112, the cam 146 causes the cam plates 136 to drop away from the diffuser blocks 112. Because the air discharging from the orifices 126a maintains the upper side panel 14a of the flat tube 12 against the diffuser block surface 112a, the forward portion of the bottom side panel 14b of the tube drops away from the upper panel 14a to separate the leading edges of the tube.

Substantially simultaneously with separation of the leading edges of the flat tube, air is discharged from the nozzles 166 in the upstream brake housings 154 to create a drag on the lower side panel 14b of the tube so as to restrain its forward movement relative to continued movement of the top panel 14a. As a result, the top leading edge or longitudinal fold line between the gusset panel 16a and top side panel 14a which contains the slit 20a is fed between the feed roll 86 and pinch roll 88 which cooperate to continue forward movement of the top panel 14a of the flat tube after the tube exits from the upstream feed rolls 68 and 70.

The air drag acting on the lower side panel 14b from the drag means 110 is of sufficient magnitude so that as the upper side panel 14a progresses through the feed rolls 86 and 88, the gusset panel 16b and upper rearward gusset panel 18a are withdrawn from their folded positions internally of the side panels so that the gusset panels 16a and 16b lie substantially coplanar with the side panel 14b while the gusset panels 18a and 18b lie substantially coplanar with the upper side panel 14a. In this condition, the flat tube is positioned with the slits 20a and 20b in its leading and trailing edges thus preparing the flat tube for subsequent cuffing of the tube at the end intersected by the slits 20a, b. The control cam 180b is configured to terminate the suction drag on an associated side panel 14b of a tube 12 prior to termination of air discharge from the air diffuser orifices 126c.

In subsequent operations, the gussets 16 and 18 are folded back into the tube between the side panels 14a, b and the end opposite the cuffed end is heated sealed, folded and glued to form a closed bottom bag. The latter operations do not form a part of the present invention and are not described in detail herein.

Thus, in accordance with the present invention, a method and apparatus are provided for removing longitudinal gussets from a substantially flat tube of flexible material wherein the flat tube is moved along a guide path by conveyor means in a direction transverse to the longitudinal axis of the tube so as to establish leading and trailing tube edges. The leading edges of the flat tube 12 are separated within the gusset removal station 30 by cooperation of air diffuser means and tube lifter cam means to enable advance of the upper leading edge of the flat tube between feed rolls which advance the upper side panel while tube holder or drag means simultaneously operates on the lower side panel to restrict its forward movement. This action causes the gussets to be withdrawn from their inwardly folded positions between the side panels so that the gusset panels lie in substantially coplanar relation with the side panels. The longitudinal gussets are thus removed from the flat tube in a manner to prepare the tube for forming a circumferential cuff at a selected end of the tube. It will be appreciated that gases other than air may be employed in the edge separating means 108 and tube holder or drag means 110 if desired.

While a preferred embodiment of the present invention has been illustrated and described, it will be understood to those skilled in the art that changes and modifications may be made therein within departing from the invention in its broader aspects. Various features of the invention are defined in the following claims.

What is claimed is:

1. Apparatus for removing longitudinal gussets from a substantially flat tube of flexible material wherein the gussets are formed along opposite edges of the flat tube and each gusset includes a pair of connected gusset panels lying in juxtaposed relation between substantially flat side panels of the tube, said apparatus comprising, in combination, frame means, first feed means supported by said frame means and adapted to move a substantially flat tube in a predetermined direction substantially transverse to the longitudinal axis of the tube so as to define pairs of leading and trailing edges of the flat tube, edge separating means supported by said frame means for cooperation with a tube as it is moved along said predetermined direction, said edge separating means including gas diffuser means and tube lifter means cooperative to separate the leading edges of said tube, second feed means adapted to receive at least one of said separated leading edges so as to effect continued movement of the corresponding side panel of said tube in said predetermined direction, and tube holder means supported by said frame means for cooperation with said tube to apply a drag to the other of said side panels of the tube substantially simultaneously with feeding of said at least one of said separated leading edges into said second feed means so that continued movement of said corresponding side panel effects removal of said gussets panels from between the side panels so as to lie substantially coplanar with the side panels.

2. Apparatus as defined in claim 1 wherein said first feed means includes feed rolls adapted to receive a substantially flat tube therebetween and effect movement of the tube in said predetermined direction.

3. Apparatus as defined in claim 1 wherein said gas diffuser means includes at least one gas diffuser block having a gas diffuser orifice therein adapted to effect discharge of gas in an annular diffused pattern, said tube lifter means including at least one lifter cam plate adapted for movement between a first position adapted to receive a flat tube thereon from said first feed means and a second position wherein one of the side panels of said tube is positioned adjacent said diffuser block so that said one of said side panels is impinged by and maintained against said diffuser block by diffused gas discharge while continuing movement in sliding relation thereover.

4. Apparatus as defined in claim 1 wherein said second feed means is spaced downstream from said first feed means a distance slightly less than the transverse width of said flat tube prior to removal of said longitudinal gussets therefrom.

5. Apparatus as defined in claim 2 wherein said second feed means includes at least one drive roll and a corresponding pressure roll movable between a first position spaced from said drive roll and a second position cooperative with said drive roll to receive and effect movement of a flat tube therebetween, and means for effecting selective movement of said pressure roll between its said first and second positions.

6. Apparatus as defined in claim 1 wherein said flat tube has longitudinal slits formed in diametrically opposite fold lines connecting selected ones of said gusset panels to their respective side panels, said longitudinal slits extending from an open end of the tube a predetermined distance longitudinally therealong, said edge separating means and said tube holder means being cooperative to remove said gussets in a manner such that the resulting leading and trailing edges of the flat tube each have one of said longitudinal slits formed therein.

7. Apparatus as defined in claim 3 wherein said gas diffuser orifice is configured to establish a gas film layer between said diffuser block and said one of said side panels to enable sliding movement of said one of said side panels on said gas film layer, and means connected to said gas diffuser block for supplying gas thereto for discharge through said diffuser orifice.

8. Apparatus as defined in claim 1 including control means interconnecting said first and second feed means and said tube lifter means so as to effect movement of said tube lifter means in predetermined relation to said feed means.

9. Apparatus as defined in claim 1 wherein said tube holder means comprises gas flow means adapted to apply a suction drag to said other of said side panels.

10. Apparatus as defined in claim 3 wherein said diffuser block is supported to overlie the path traversed by a substantially flat tube moving from said first to said second feed means, said diffuser block having a contact surface intersected by said diffuser orifice and adapted to be engaged by said one of said side panels which said lifter cam plate is moved to its said second position.

11. Apparatus as defined in claim 3 including a plurality of said diffuser blocks supported by said frame means in aligned relation transverse to the direction of movement traversed by a tube passing between said first and second feed means.

12. Apparatus as defined in claim 10 including means supporting said diffuser block so as to enable selective orientation of said contact surface relative to the path traversed by a flat tube between said first and second feed means.

13. Apparatus as defined in claim 3 wherein said tube holder means includes at least one air brake housing having a support surface formed thereon positioned to be engaged by a substantially flat tube after leaving said first feed means, said air brake housing having air flow passage means therein including an orifice intersecting said support surface, and air nozzle means supported by said brake housing in communication with said air flow passage means so that air discharged from said nozzle means effects a drag on the adjacent side panel of a flat bag passing over said support surface to inhibit movement of said adjacent side panel, and air supply means operatively associated with said air nozzle means to effect selective air passage therethrough so as to effect said drag on said adjacent side panel.

14. Apparatus as defined in claim 3 including a plurality of said gas diffuser blocks supported in aligned relation tranverse to said predetermined direction, and a corresponding number of said lifter cam plates cooperable with said gas diffuser blocks to position a side panel of a flat tube against said gas diffuser blocks and thereafter effect dropping away of the opposite side panel of the tube so as to separate the leading edges of the tube preparatory to removing the gussets therefrom.

15. Apparatus as defined in claim 13 including means connecting said air supply means to said gas diffuser block, and control means operatively associated with said air supply means so as to effect flow of air to said gas diffuser block and said air nozzle means in predetermined relation so that air supply to said air nozzle means is terminated after removal of the gussets from a tube, followed by termination of air supply to said gas diffuser block.

16. A system for removing longitudinal gussets from a substantially flat tube of flexible material wherein the gussets are formed along opposite edges of the flat tube and each gusset includes a pair of connected gusset panels lying in juxtaposed relation between substantially flat side panels of the tube, said system comprising, in combination, conveyor means for conveying said tube along a guide path in a direction substantially transverse to the longitudinal axis of the tube so as to define pairs of leading and trailing edges of the flat tube as it moves along the guide path, and a gusset removing station including first feed means adapted to receive a substantially flat tube from said conveyor means and effect continued movement of the tube in a predetermined direction, said gusset removing station further including means cooperative with a tube as it is moved in said predetermined direction to separate the leading edges thereof, second feed means adapted to receive at least one of said separated leading edges so as to effect continued movement of one of the side panels of said tube in said predetermined direction, and tube holder means adapted to apply a drag to the other of the side panels substantially simultaneously with said continued movement of said one of said side panels so as to effect removal of said gusset panels from their said juxtaposed relation between the side panels and cause said gusset panels to lie substantially coplanar with the side panels of the tube.

17. A system as defined in claim 16 wherein said conveyor means is adapted to sequentially convey a plurality of said substantially flat tubes along said guide path.

18. A system as defined in claim 16 wherein said first and second feed means each includes pairs of feed rolls driven in predetermined relation to movement of said conveyor means.

19. A system as defined in claim 16 wherein said means for separating said leading edges of a flat tube includes air diffuser means and tube lifter means cooperative to separate the leading edges of a tube as it is moved in said predetermined direction through said gusset removing station.

20. A system as defined in claim 19 wherein said tube holder means includes air flow means adapted to apply a suction drag to said other of said side panels.

21. A system as defined in claim 20 including air supply means adapted to suppy air to said air diffuser means and said air flow means, and control means operatively associated with said air supply means and adapted to effect air flow to said air diffuser means and said air flow means in predetermined relation.

22. The system as defined in claim 21 wherein said control means includes control cam means operative to terminate air supply to air flow means and said air diffuser means in timed relation to passage of a substantially flat tube through said gusset removing station.

23. The system as defined in claim 22 wherein said control cam means is adapted to terminate said air supply to said air flow means prior to termination of air to said air discharge means for each tube passed through said gusset removing station.

24. A method for removing longitudinal gussets from a substantially flat tube of flexible material having opposite side panels and wherein each gusset includes a pair of gusset panels connected to each other along a longitudinal fold line and connected to respective ones of the side panels along fold lines so that the gusset panels are foldable to lie in juxtaposed relation between said side panels, said method comprising the steps of:

(a) moving the substantially flat tube along a guide path in a direction generally transverse to the longitudinal axis of the tube so as to establish leading and trailing edges, (b) separating the opposite side panels from each other at their leading edges while continuing to move the tube along said guide path while disposed generally transverse thereto, and (c) simultaneously restricting forward movement of one of said side panels while continuing to advance the other of said side panels so as to cause said gusset panels to be withdrawn from their folded positions between said side panels and lie in substantially coplanar relation with said side panels.

25. The method as defined in claim 24 wherein said opposite side panels are separated from each other at their leading edges by contacting said other of said side panels with gas diffuser means operative to maintain said other of said side panels in contact with said gas diffuser means while enabling continued movement of said other of said side panels in said predetermined direction, and simultaneously enabling said one of said side panels to move away by gravity from said other of said side panels so as to separate the leading edges of said side panels.

26. The method as defined in claim 25 including the further step of introducing the leading edge of said other of said side panels into feed roll means operative to advance said other of said side panels after said opposite side panels are separated at their leading edges.

27. The method as defined in claim 24 wherein said step of restricting forward movement of said one of said side panels is effected by applying a drag force to said one of said side panels.

28. The method as defined in claim 27 wherein said drag force is effected by air flow means operative to subject said one of said side panels to a suction action.

29. The method as defined in claim 28 wherein said suction is effected by establishing flow of air through a venturi orifice operative to effect a pressure drop thereacross, and establishing communication between the lower pressure at the exit end of said orifice with a surface contacting said one of said side panels so that a suction drag is applied to said one of said side panels as the tube progresses along said guide path.

* * * * *